US005469790A

United States Patent [19]

Singer

[11] Patent Number: 5,469,790

[45] Date of Patent: Nov. 28, 1995

[54] AERODYNAMIC PROJECTILE AND MEANS FOR PROPELLING SAME

[76] Inventor: John S. Singer, Bayberrie Dr., Westover Park, Stamford, Conn. 06902

[21] Appl. No.: 122,702

[22] Filed: Sep. 15, 1993

[51] Int. Cl.[6] ..... F42B 5/18

[52] U.S. Cl. ..... 102/431; 102/436; 102/501; 244/3.24

[58] Field of Search ..... 102/431, 432, 102/436, 501, 700, 438, 703; 244/3.1, 3.24

[56] References Cited

U.S. PATENT DOCUMENTS

| | | | |
|---|---|---|---|
| 3,132,587 | 5/1964 | Fuller | 102/436 |
| 3,145,658 | 8/1964 | Glasser | 102/436 |
| 3,563,177 | 2/1971 | Ritchey | 102/431 |
| 3,577,921 | 5/1971 | Van Langenboven | 102/431 |
| 3,815,507 | 6/1974 | Irish, Jr. et al. | 102/431 |
| 3,854,400 | 12/1974 | Van Langenhoven | 102/431 |
| 4,213,392 | 7/1980 | Usel | 102/431 |
| 4,337,911 | 7/1982 | Flatau | 102/501 |

*Primary Examiner*—Harold J. Tudor
*Attorney, Agent, or Firm*—Murray Schaffer

[57] ABSTRACT

An aerodynamic planar projectile carries an exposed propellant charge. The projectile is loaded into a specially designed gun that has a firing chamber and a barrel designed to receive and guide the projectile. When the trigger is pulled, an electric current heats an element which ignites the propellant. The propellant explodes driving the projectile from the chamber and down the barrel with lethal velocity.

3 Claims, 5 Drawing Sheets

AERODYNAMIC PROJECTILE AND MEANS FOR PROPELLING SAME

FIELD OF THE INVENTION

This invention relates to firearms and, more particularly, to a novel aerodynamic planar projectile and complementary gun wherein an exposed propellant is configured to conform to and become part of the geometry of the projectile.

BACKGROUND OF THE INVENTION

Percussion type firearms are well known. Most use projectiles or bullets of the closed cartridge type. That is to say that a conventional round comprises a forward slug or projectile and a rearward case packed with the explosive charge (gunpowder). While the prior art shows a variety of guns, munitions, and firing systems, generally the ammunition is complex, costly, cumbersome and heavy.

BRIEF DESCRIPTION OF THE INVENTION

In general, the present invention overcomes the drawbacks noted above and provides for a simplified firearm or weapon system. According to the inventive system, an aerodynamic planar projectile is fired from a complementary gun. The inventive projectile carries its explosive propellant as, preferably, an exposed tail or conformal extension of the projectile. The gun has a firing chamber configured complementary to the outer periphery of the projectile so as to receive the same. The barrel of the gun communicates with the firing chamber and, in elevation, has a cross section configured to receive and guide the projectile as the same traverses therethrough. The firing chamber includes a heating element that is powered electrically. When current is triggered into the heating element, the same heats quickly and ignites the propellant. The resulting explosion in the firing chamber propels the projectile from the chamber and down the barrel. The small thin planar configuration of the projectiles (which reduces aerodynamic drag) in combination with their true "firearm" type or explosive propulsion system causes them to exit the barrel at speeds that are lethal. And the geometry of the projectiles allows one to stack on another forming a compact magazine for rapid fire.

OBJECTS OF THE INVENTION

It is therefore an object of the present invention to provide a novel firearm wherein a small aerodynamic planar projectile carries its propellant as a conformal part of the same.

A significant object of the present invention is to provide an extremely lightweight, nondetectable gun having only one movable part.

It is another object of the present invention to provide a novel firearm wherein a projectile that carries its propellant as an exposed conformal part thereof can be "fired" or ignited electrically.

It is a further object of the present invention to provide a planar projectile that when fired from a complementary configured gun barrel is lethal, and owing to its relatively thin planar configuration exhibits enhanced aerodynamic properties.

It is another object of the present invention to provide a gun that fires a planar projectile and wherein the geometry of the projectile allows the same to be stacked compactly in magazine form.

It is one more object of the present invention to provide a firearm and ammunition therefor that uses electrically generated heat as the firing system and wherein the components comprising a given round of ammunition are reduced to the barest minimum, making such round simple in design, light in weight, and inexpensive to manufacture.

DESCRIPTION OF THE DRAWINGS

Other objects and features of the present invention will be apparent from the following detailed description considered in connection with the accompanying drawings. It is to be understood, however, that the drawings are designed for purposes of illustration only and not as a definition of the limits of the invention for which reference should be made to the appending claims.

In the drawings, wherein the same reference numeral denotes the same element throughout the several figures.

DETAILED DESCRIPTION OF THE INVENTION

Figure 1:
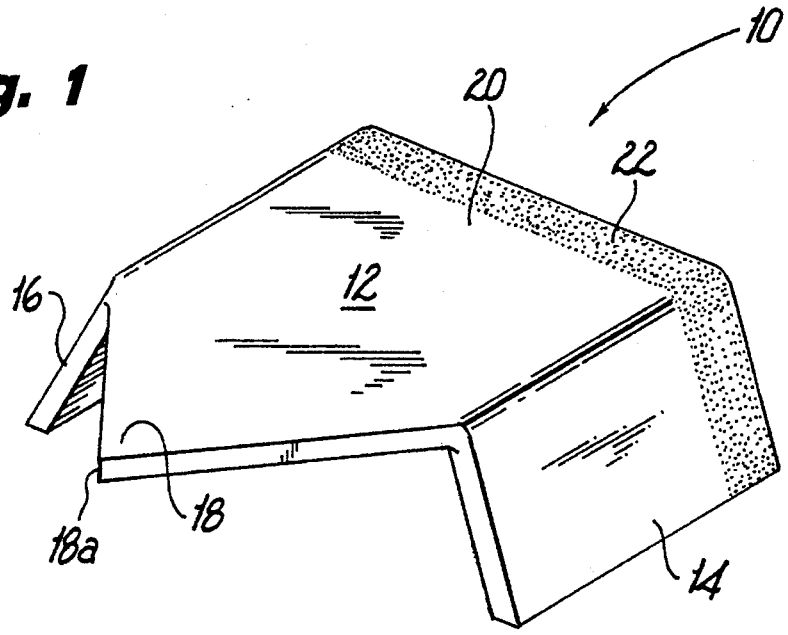
FIG. 1 is a perspective view of one form of a planar projectile or dart according to the present invention.
Figure 2:
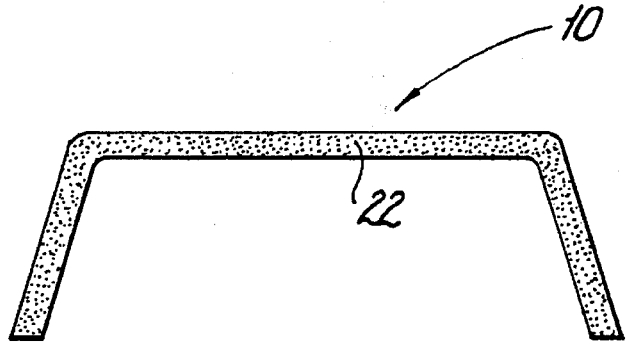
FIG. 2 is an end elevation of the projectile seen in FIG. 1, the projectile is seen from the trailing edge to show how the propellant is conformally formed on this edge.

Referring now to FIGS. 1 and 2, there is shown one form of the inventive projectile or dart seen generally as reference numeral 10. Projectile 10 is preferably of flat thin sheet stock and includes a stabilizer or body part 12. Depending laterally from body 12 is a pair of opposed relatively downwardly depending fins or wings 14 and 16. More particularly, projectile 10, in plan view, is symmetric about a central longitudinal axis. Fins 14 and 16 are in spaced disposition about this central longitudinal axis and are integrally formed with body part 12. Each fin assumes an angulated, downward disposition or cast with respect to the plane of body 12 whereby projectile 10, when seen in end elevation, has a relatively downward dihedral. The cited disposition of fins 14 and 16 affords aerodynamic stability to the projectile when the same is in flight.

Body part 12 is, in plan view, further defined by a leading lip or edge 18 and spaced therefrom a trailing edge 20. Preferably, leading edge 18 tapers to a pointlike nose 18*a*. The entire leading lip of projectile 10 can be sharpened for enhanced penetrating effect as will be discussed below.

An explosive propellant charge 22 is attached or molded to trailing edge 20 of projectile 10. As seen clearly in FIG. 2, charge 22 has a geometry that, preferably, conforms to the shape of trailing edge 22. Or stated differently, charge 22 is conformally molded to edge 18 so that the charge, when seen both in elevation and plan view, assumes the form of trailing edge and becomes like an integral extension thereof.

Figure 3:
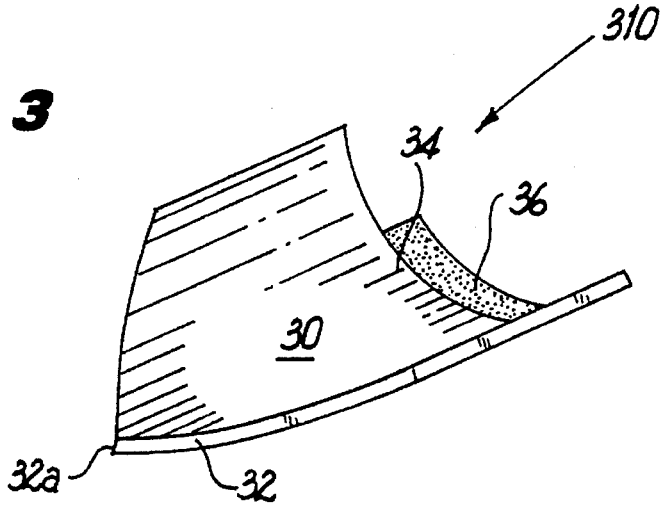
FIG. 3 is a perspective view of another embodiment of a projectile or dart according to the present invention.

Referring now to FIG. 3, there is shown another embodiment of a projectile according to the present invention seen generally as reference numeral 310. In the embodiment of FIG. 3, projectile 310 is formed of a contoured body part 30 that, in transverse cross section, has a generally arcuate form and when seen in perspective view, appears to have a cylindrical contour with a relatively upward "dihedral". As with projectile 10, projectile 310 is, in plan view, symmetric about a central longitudinal axis for aerodynamic stability in flight. Body 30 is formed with a leading edge 32, that, in plan view, tapers to a relatively pointed nose 32*a*. A trailing edge 34 is spaced from leading edge 32, as shown. An explosive charge or propellant is conformally molded to trailing edge 34 as an integral extension thereof. It will be noticed, however, that in the embodiment of FIG. 3, propellant charge 36, while conforming to the cross sectional geometry of projectile 30 (when seen in plan and elevational views), covers or is deposited along only a portion of trailing edge 34.

Since the projectiles of the present invention are, in a manner of speaking, planar members, they readily stack one on top of another to form a compact magazine array. This magazine array can be realized by, for example, use of a light duty adhesive or wax interposed between the confronting projectiles, or if the projectiles are made from magnetic material, magnetizing then so that confronting peripheries attract. Propellants 22 and 36 are used to fire their respective projectiles during use and operation of the inventive weapon as will be described below.

Figure 4:
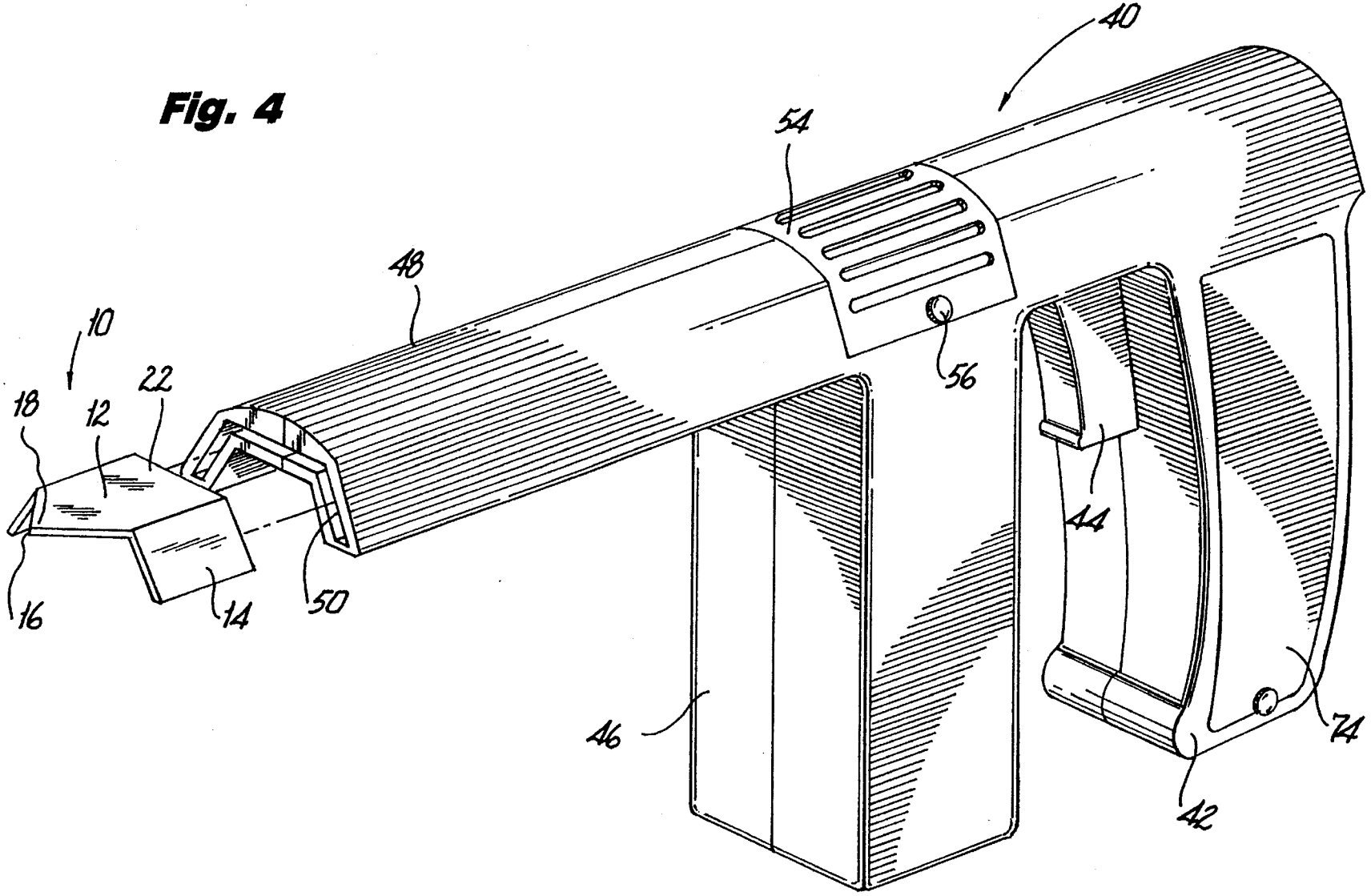
FIG. 4 is a perspective view of a projectile gun according to the present invention showing one of the planar projectiles being fired from its barrel.
Figure 5:
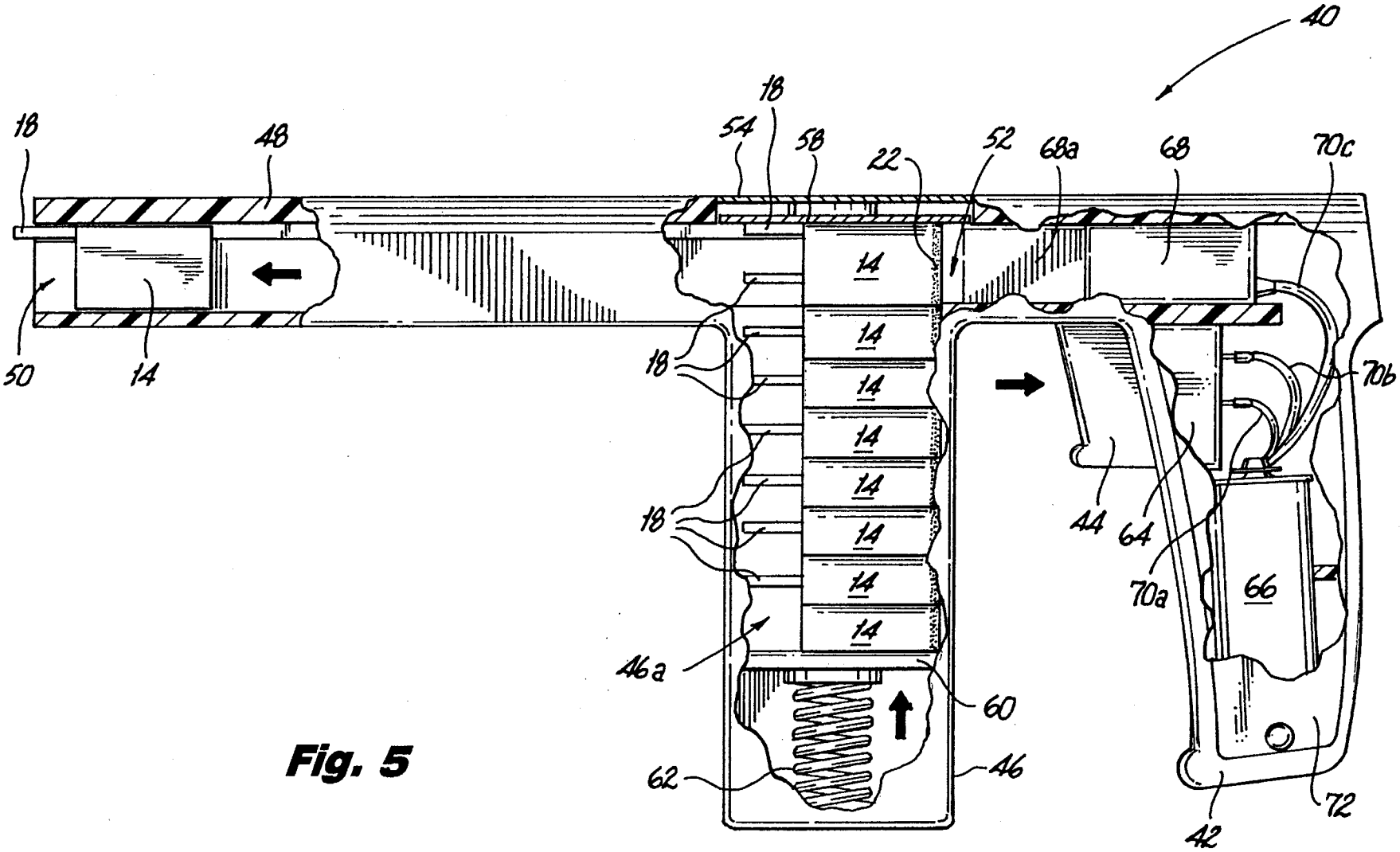
FIG. 5 is an elevational view, partly in section, of the gun shown in FIG. 4.
Figure 6:
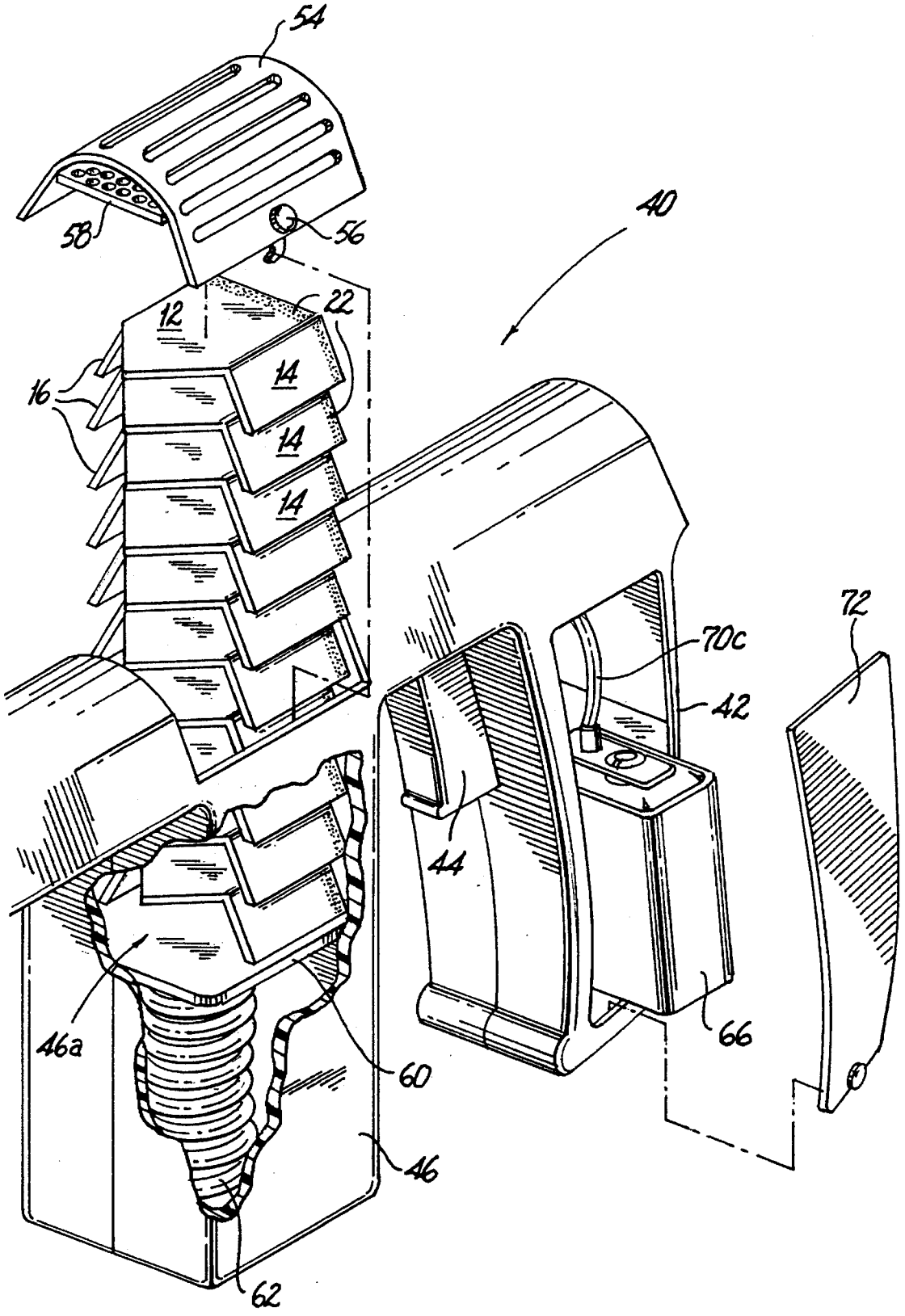
FIG. 6 is a partial perspective view of the gun seen in FIG. 4, parts of the gun housing are broken away and a magazine of projectiles are seen being loaded in the gun's magazine chamber.

Turning now to FIGS. 4–6, the inventive projectile gun is seen generally as reference numeral 40. Gun 40 includes a handle 42 with trigger 44. A magazine housing 46 that includes a magazine loading chamber or bay 46*a* is attached to gun 40 for storing a magazine array of projectiles. A projectile guideway 48 forms the barrel of gun 40. This configuration, preferably, gives gun or gun body 40 the appearance, to some degree, of a conventional firearm.

More particularly, barrel 48 is formed with a projectile bore 50 that is complementary to the outer periphery of a given projectile, which, in this case, is projectile 10 of FIGS. 1 and 2. Put another way, the transverse cross section of bore 50 conforms to the transverse cross section or periphery of a given projectile when seen in end elevation. The internal end of bore 50 communicates with a firing chamber of breech area 52. Firing chamber 52 is covered by a pivotal or removable breech lid 54. Lid 54 includes a latch 56 to secure the lid to the gun body. The pivotal or removable action of lid 54 permits the loading of gun 40 with one or a plurality of projectiles as will be described below.

The underside of lid 54 carries a projectile stop 58 that conforms to the confronting face of a given projectile. Hence, in the embodiment under discussion, since the confronting portion of projectile 10 is planar body part 12, stop 58 is in the form of a complementary plate attached to the underside of lid 54. It will be noticed that, in essence, the face of stop 58 that confronts the projectile forms part of firing chamber 52. A magazine follower or platform 60 is carried in magazine loading chamber 46*a* of housing 46. A magazine spring 62 is, on one end, designed to react against the bottom floor of chamber 46*a* and, on the other end, react on the underside of magazine follower 60. It will be apparent that, in plan view, the transverse cross sectional configuration of magazine chamber 46*a* is designed to match the footprint presented by the magazine array of projectiles. In this way, the magazine array can be received and held in magazine 46 as the gun is loaded.

Gun 40 further includes the means used to fire a given projectile when the same is loaded or driven into position in firing chamber 52. In the embodiment shown in FIGS. 4–6, this means includes an electrical switch assembly 64, battery 66 and electrically powered heating generating means 68. More specifically, trigger 44 operates switch 64 which, by means of leads 70*a*, 70*b*, and 70*c*, applies electric current to heat generating means 68. In the embodiment of FIGS. 4–6, the heat generating means comprises a resistive element 68*a* which forms a wall of or projects into firing chamber 52.

A removable cover 72 provides access to battery 66.

In use and operation of the invention, lid 54 is opened. A stacked array or magazine of projectiles 10 is loaded into magazine chamber 46*a* by pushing them down onto magazine follower 60. Lid 54 is then pivoted or placed back onto gun 40 and secured thereto with latch 56. To fire the weapon, the trigger is pulled. This sends an electric current into heating element 68*a* causing the same rapidly to generate a high temperature. Such heating causes propellant 22 on the given projectile in chamber 52 to explode. The expanding gas drives projectile 10 down barrel bore 50 to exit the same in the direction of the target. As the discharged projectile leaves the firing chamber, spring 62 urges the next and new projectile on the magazine array into firing chamber 52. The new projectile in firing chamber 52 is driven against stop plate 58 to be held in abutting relation therewith by action of spring 62 reacting on follower 60, with the latter pushing on the bottom of the magazine array. Thus, the next round is held ready in chamber 52 to be fired out of bore 50 when its propellant is set off (trigger 44 is pulled) as noted above.

Should the user desire, a steady, sequential, rapid firing of the projectiles can be effected by maintaining a constant pressure on the trigger.

Figure 7:
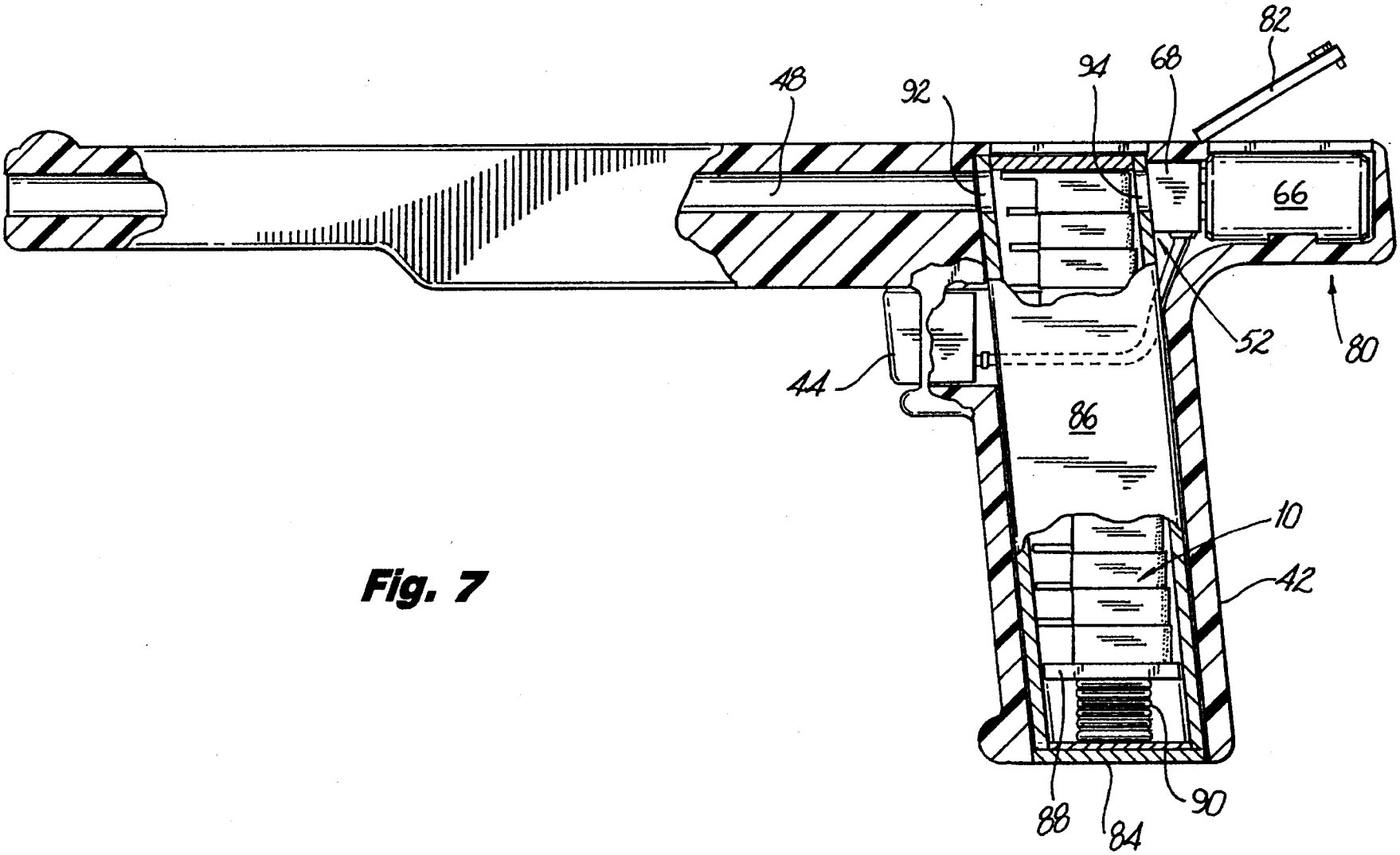
FIG. 7 is an elevational view partially in section showing another embodiment of the gun of the present invention.

In the embodiment illustrated in FIG. 7, parts similar in structure and function to those shown in the preceding figures bear similar numerals and, unless required, are not further described. The gun is arranged so that the projectiles are magazine loaded through the handle rather than through a separate loading bay.

In this embodiment, the battery 66 is housed in an extension 80 behind the barrel. The top of the extension is provided with a cap 82 allowing access for replacement of the battery. The handle 42 is open at the bottom 84 for the receipt of a magazine 86. The magazine 86 contains a stack of projectiles 10, otherwise similar to those earlier described, resting on a platform 88 biased by a spring 90. The magazine 86 is closed at its top and bottom ends, but is provided with openings 92 and 94 in its forward and rear edges aligned with the firing chamber 52 and the barrel 48. The firing chamber 52 and the ignition means 68 are arranged behind the handle so that, upon insertion of the magazine, the topmost projectile sits in firing position. Both the magazine and the handle are provided with suitable dents, ridges and the like whereby the projectiles and the magazine, respectively, are held in stable position.

The gun illustrated in FIG. 7 is otherwise similar in construction and operation to the gun described earlier.

Heating element 68*a* should have a small thermal inertia, that is, it should cool quickly for safety reasons. And, while the system used to fire the propellant shown in the present embodiment is by means of an electrically operated heat element, the invention is not to be so limited. There are many ways that those skilled in this art can use to ignite the propellant. For example, an electric current applied directly to and through an appropriate propellant can be used to ignite the same. Then, too, lasers can be used to ignite an appropriate propellant as well as ultrasonic means, friction means, percussion means, or RF energy to name a few.

The form of the thin, essentially planar, projectile or dart is also not to be limited to the embodiments shown. It will be apparent to those skilled in this art that the projectile can take many forms. The criteria to be considered is that the projectile's form enhances its aerodynamic stability. Moreover, the shape of the overall projectile can be designed to provide a small amount of aerodynamic lift thus compensating, to some degree, for the effects of gravity.

The leading edge of the projectile can be sharpened to a razor-like edge and hardened for a particularly lethal effect. Sharpening the leading edge of the projectile will further reduce aerodynamic drag. Indeed, the leading edge of the projectile can be treated with a given coating for a desired penetrating effect. Preferably, the projectile is fabricated from relatively high temperature plastic or other nonmetallic materials such as ceramics and composites, although, of course, metal may be used. In fact, the whole gun can be fabricated from similar compatible material.

It should be kept in mind that while magazine housing 46 is shown as an integral part of gun 40, the magazine can be supplied as a fully loaded, stand-alone detachable magazine clip designed to snap into gun 40. Furthermore, lid 54 as a movable piece can be deleted and replaced with equivalent structure that is made integral or monolithic with gun 40. This might be the case when a detachable magazine clip is used because the projectiles would come preloaded in the clip. Reloading would then merely require removing the spent clip and replacing it with a loaded one in conventional manner.

And, it is to be further understood that the propellant used to fire a given projectile need not have to conform exactly to the geometric form of the projectile's trailing edge. A charge of propellant of nearly any form can be tacked on or applied to such edge and used to propel the projectile. In fact, the propellant can be applied as a coating contiguous to or along the trailing edge of the projectile. The important criteria is that the propellant be completely stable until set off in chamber 52.

The projectile may be formed, and the propellant selected, so that the charge is relatively slow burning and not immediately consumed in the chamber when contacted with the heating element. In this manner, the propellant charge may continue to burn even after the projectile leaves the barrel thus providing the projectile with a rocket-like burst while in flight.

While only a few embodiments of the present invention have been shown and described, it is to be understood that many changes and modifications can be made hereto without departing from the spirit and scope hereof.

What is claimed is:

1. A projectile for a firearm comprising a thin planar member of aerodynamic configuration and having a central body part that, in plan view, is generally symmetric about a central longitudinal axis, a pair of opposed fins integrally formed with said central body part in angulated configuration with respect to said central body part and in spaced disposition about the central longitudinal axis such that the disposition of said fins affords aerodynamic stability to the projectile when the same is in flight, said central body part, in plan view, having a leading edge and a trailing edge, ignitable propellant means applied directly to the trailing edge of said central body part such that when said propellant means is heated rapidly, the same ignites driving the projectile from the firearm at high velocity.

2. The projectile of claim 1, each of said fins being given a relatively downward disposition so that the projectile, in end elevation, has a relatively downward dihedral.

3. A plurality of projectiles each projectile comprising a thin planar member of aerodynamic configuration and having a central body part that, in plan view, is generally symmetric about a central longitudinal axis, a pair of opposed fins integrally formed with said central body part in angulated configuration with respect to said central body part and in spaced disposition about the central longitudinal axis such that the disposition of said fins affords aerodynamic stability to the projectile when the same is in flight, said central body part, in plan view, having a leading edge and a trailing edge, ignitable propellant means applied directly to the trailing edge of said central body part such that when said propellant means is heated rapidly, the same ignites driving the projectile from the firearm at high velocity, wherein each of said projectiles has a cross section that allows one projectile to be stacked surface to surface on another.

* * * * *